US006196454B1

(12) United States Patent
Sadlier

(10) Patent No.: US 6,196,454 B1
(45) Date of Patent: Mar. 6, 2001

(54) INSULATED CUP AND METHOD OF MANUFACTURE

(75) Inventor: Claus E. Sadlier, San Francisco, CA (US)

(73) Assignee: Insulair, Inc., San Francisco, CA (US)

( * ) Notice: Subject to any disclaimer, the term of this patent is extended or adjusted under 35 U.S.C. 154(b) by 0 days.

(21) Appl. No.: 09/588,859

(22) Filed: Jun. 6, 2000

Related U.S. Application Data

(62) Division of application No. 09/201,621, filed on Nov. 30, 1998, now Pat. No. 6,085,970.

(51) Int. Cl.[7] ..... B65D 3/22

(52) U.S. Cl. ..... 229/403; 229/4.5; 229/198.2; 229/939; 493/96; 493/108; 493/154; 493/907

(58) Field of Search ..... 229/4.5, 400, 403, 229/198.2, 939; 493/96, 106, 108, 109, 111, 152, 154, 155, 907

(56) References Cited

U.S. PATENT DOCUMENTS

| | | | | |
|---|---|---|---|---|
| 536,545 | | 3/1895 | Schmidt | 229/4.5 |
| 1,091,526 | | 3/1914 | Moore | 493/108 |
| 1,158,581 | | 11/1915 | Swift | 229/5.5 |
| 1,208,483 | | 12/1916 | Chesbough | 229/939 |
| 1,284,728 | | 11/1918 | Luellen | 229/4.5 |
| 1,294,210 | | 2/1919 | Wallertz | 229/4.5 |
| 1,771,765 | | 7/1930 | Benson | 229/4.5 |
| 2,457,198 | | 12/1948 | Bell | 229/4.5 |
| 2,512,602 | | 6/1950 | Bell | 229/5.5 |
| 3,106,327 | * | 10/1963 | Karl | 229/4.5 |
| 3,242,829 | * | 3/1966 | White | 229/4.5 |
| 3,414,184 | * | 12/1968 | Loheed | 229/198.2 |
| 3,456,863 | * | 7/1969 | Mollison et al. | 229/198.2 |
| 3,581,972 | | 6/1971 | Buchner et al. | 229/4.5 |
| 3,908,523 | | 9/1975 | Shikaya | 229/939 |
| 4,080,880 | | 3/1978 | Shikaya | 493/273 |
| 4,347,934 | | 9/1982 | Goodman | 206/663 |
| 4,511,078 | * | 4/1985 | Rauser et al. | 229/198.2 |
| 4,617,211 | * | 10/1986 | Fries, Jr. | 229/198.2 |
| 4,715,527 | * | 12/1987 | Tsuzuki et al. | 229/198.2 |
| 4,934,591 | | 6/1990 | Bantleon | 229/198.3 |
| 5,092,485 | | 3/1992 | Lee | 229/403 |
| 5,205,473 | | 4/1993 | Coffin, Sr. | 229/939 |
| 5,226,585 | | 7/1993 | Varano | 229/403 |
| 5,256,131 | | 10/1993 | Owens et al. | 493/374 |
| 5,326,019 | | 7/1994 | Wolff | 229/4.5 |
| 5,363,982 | | 11/1994 | Sadlier | 229/403 |
| 5,385,260 | | 1/1995 | Gatcomb | 229/403 |
| 5,425,497 | | 6/1995 | Sorensen | 220/738 |
| 5,454,484 | | 10/1995 | Chelossi | 220/738 |

(List continued on next page.)

FOREIGN PATENT DOCUMENTS

| | | | | |
|---|---|---|---|---|
| 0371918 | | 6/1990 | (EP) . | |
| 1167861 | | 10/1969 | (GB) . | |
| 1366310 | | 9/1974 | (GB) . | |
| 2016640 | * | 9/1979 | (GB) | 229/4.5 |

*Primary Examiner*—Gary E. Elkins
(74) *Attorney, Agent, or Firm*—David Pressman

(57) ABSTRACT

An insulating cup or container (50) and a method of manufacturing it comprises (first embodiment) providing a sidewall blank (12B) having two sections separated by a fold score (15), and a separate insulating sheet (18)(corrugated, ribbed, embossed, foamed, perforated, etc.) which is adhesively fastened to one of the sections. The blank is folded in half along the fold score, to form a three-layered assembly with the insulating sheet in the middle. To reduce the thickness of the seam, the blank is thinned in the area adjacent a fold score prior to folding. The assembly is wrapped around a mandrel to bring the outer edges together at a side seam (22S) to form a sidewall 12. The side seam is sealed, the bottom is added, and the rim is formed. In a second embodiment, the insulating layer can be a coating on one or both of the sections of the two-section starting blank. In a third embodiment, the insulating section (40) can be integral with, and extend from, one edge of the starting blank. It is folded over first to form the middle layer of the wrappable assembly.

10 Claims, 9 Drawing Sheets

U.S. PATENT DOCUMENTS

| | | | | |
|---|---|---|---|---|
| 5,460,323 | | 10/1995 | Titus | 229/403 |
| 5,490,631 | | 2/1996 | Iioka et al. | 229/403 |
| 5,542,599 | | 8/1996 | Sobol | 229/403 |
| 5,547,124 | | 8/1996 | Mueller | 229/403 |
| 5,660,326 | | 8/1997 | Varano et al. | 229/403 |
| 5,685,480 | | 11/1997 | Choi | 229/403 |
| 5,697,550 | * | 12/1997 | Varano et al. | 229/403 |
| 5,766,709 | | 6/1998 | Geddes et al. | 229/403 |
| 5,769,311 | | 6/1998 | Morita et al. | 229/403 |
| 5,775,577 | | 7/1998 | Titus | 229/403 |
| 5,810,243 | * | 9/1998 | Dipinto et al. | 229/198.2 |
| 5,952,068 | * | 9/1999 | Neale et al. | 229/403 |
| 5,964,400 | * | 10/1999 | Varano et al. | 229/403 |
| 6,085,970 | * | 7/2000 | Sadlier | 229/403 |

* cited by examiner

INSULATED CUP AND METHOD OF MANUFACTURE

BACKGROUND—CROSS-REFERENCE TO RELATED CASES

This invention is an improvement on the inventions in U.S. Pat. Re.35,830 (Jun. 30, 1998) to C. E. Sadlier, and U.S. Pat. No. 5,660,326 (Aug. 26, 1997) and U.S. Pat. No. 5,697,550 (Dec. 16, 1997) to R. Varano and C. E. Sadlier. It is a Division of application Ser. No. 09/201,621, filed Nov. 30, 1998, now U.S. Pat. No. 6,085,970, granted Jul. 11, 2000.

BACKGROUND—FIELD OF INVENTION

This invention relates generally to disposable containers and specifically to an insulated disposable cup or container and a method of manufacture.

BACKGROUND—PRIOR ART

There are three main types of disposable cups now in use: polystyrene, expanded polystyrene, and paper.

Polystyrene cups are aesthetically pleasing, but they do not provide much insulation and therefore are only used for holding cold drinks. Further they are not biodegradable or easily recycled. Condensation forms on the outside of these cups when holding a cold drink, malking the cup wet, cold, and uncomfortable to use for prolonged periods of time. Also the condensation makes the cup slippery and difficult to hold.

Cups made from expanded polystyrene (EPS), and sold under the trademark Styrofoam, are excellent thermal insulators, so that they can maintain the temperature of a drink, whether hot or cold, for long periods of time. They are inexpensive and comfortable to handle because their exteriors stay close to ambient temperature, regardless of the temperature of the drink. However, they are environmentally unfriendly because they are not biodegradable or easily recyclable. As a result, their use has been banned in some municipalities. Also, in order to print these types of cups, a slow and costly printing process must be used, because the cups must be printed after they have been formed, and their rough surface does not allow high-resolution printing.

Standard single-wall paper cups are recyclable and biodegradable and therefore more environmentally sound. However they are poor thermal insulators, so that a beverage in a paper cup quickly warms (if cold) or cools (if hot). They are also uncomfortable to handle because a hot or cold drink can burn or uncomfortably cool a hand. Also, as with the polystyrene cups, a cold drink will cause condensation to appear on the outside, making a paper cup slippery, and difficult to hold. Their single-wall construction makes them fragile, so that large cups filled with liquid may crumble after prolonged handling.

Paper cups also have a greater propensity to leak at the side seam after prolonged periods of holding liquid. This is due to the fact that once the cup's sidewall blank has been cut from a larger sheet, the cut edges do not have a waterproof barrier on them. Therefore when the cup is formed, the cut edge of the blank at the overlapping side seam—a raw edge—is exposed to the liquid inside the cup. After prolong periods of time, the liquid will wick into the paper through this raw edge. The liquid will then migrate down the side seam and through the bottom of the cup. All existing paper cups have this raw edge and potential leaking problem.

Multi-layered paper cups have been designed to provide thermal insulation and increased strength. U.S. Pat. No. 3,908,523 to Shikaya (1975), U.S. Pat. No. 5,205,473 to Coffin, Sr. (1993), U.S. Pat. No. 5,547,124 to Mueller (1996), U.S. Pat. No. 5,769,311 to Noriko et al. (1998), and U.S. Pat. No. 5,775,577 to Titus (1998) show multi-layered paper cups with an inner cup body and a multi-layered insulating wrap. The wrap provides air pockets or space for thermal insulation.

Although strong and thermally efficient, these cups are all expensive and impractical to manufacture because the inner cup body and insulating wrap are formed separately, and then must be assembled together. The outer wrap is formed from separate pieces that are laminated together, again adding additional cost. The extra steps slow the production process and prevent the cups from being made with standard cup-forming machinery.

U.S. Pat. No. 5,490,631 to Iioka et al. (1996), U.S. Pat. No. 5,725,916 to Ishii et al. (1998), and U.S. Pat. No. 5,766,709 to Geddes (1998) show paper cups coated with a foam material for insulation. These cups are also expensive to manufacture because the foam material must be coated on the cup's outer layer and then activated in order to expand the foam. The activation process is an extra step that slows and increases the expense of the production process. Another major drawback of these cups is that the textured foam surface is not conducive to printing with sharp and crisp graphics. Yet another drawback is that, although these cups are not EPS foam cups, their foam coated exterior wall still has the "look" and "feel" of foam cups, which has a negative impact on consumer acceptance.

Although the cups of the above Sadlier, and Varano and Sadlier patents are a major improvement over existing cups, I have discovered that both the cups and the manufacturing processes by which they are made can be improved.

OBJECTS AND ADVANTAGES

Accordingly, several objects and advantages of the invention are to provide a cup which (i) has improved thermal insulating properties, (ii) uses less costly materials, (iii) is leak resistant, (iv) can be formed more easily on existing cup machinery through the placement of adhesive, (v) has a surface that is conducive to printing with sharp and crisp graphics, and (vi) has an exterior wall which does not have the undesirable look and feel of foam cups, thereby providing good consumer acceptance.

Further objects and advantages will be apparent from a consideration of the ensuing description and accompanying drawings.

SUMMARY

In accordance with one embodiment of the invention, a thermally insulated cup is formed from a sidewall blank having two panels, connected along a common fold score, and a separate insulating sheet. The insulating sheet is adhesively attached to one of the panels of the sidewall blank. Adhesive is applied to an area adjacent to the fold score. The sidewall blank is then folded in half along the fold score, such that the insulating sheet is sandwiched between the two panels, thereby creating a three-layered cup blank. The adhesive which was applied adjacent the fold score bonds the two panels together at that area. The three-layered cup blank is then wrapped or bent around a mandrel and sealed at the overlapping edges. A separate bottom is sealed to the inner layer and the top of the inner layer is rolled radically outward to form a rim. To reduce the thickness of the seam, the blank is thinned in the area adjacent a fold score prior to wrapping.

DRAWING FIGURES

Figure 1:
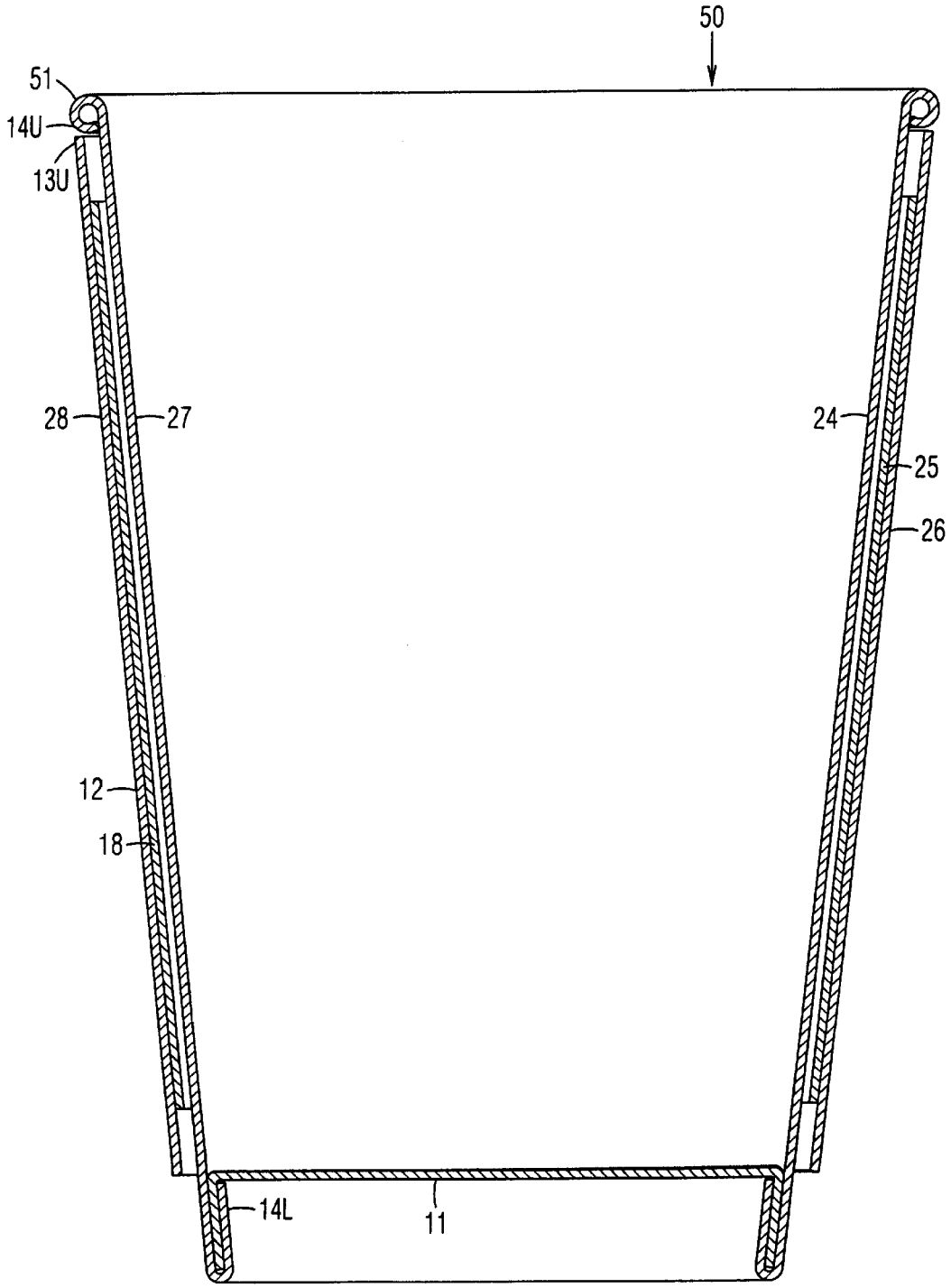
FIG. 1 is a cross-sectional elevational view of a cup made according to the present invention.

| Reference Numerals | |
|---|---|
| 11 | bottom |
| 11B | bottom blank |

-continued

| Reference Numerals | |
|---|---|
| 11I | inner surface |
| 12 | sidewall |
| 12B | sidewall blank |
| 13 | left section |
| 13B | back side |
| 13F | front side |
| 13L | lower edge |
| 13S | side edge |
| 13U | upper edge |
| 14 | right section |
| 14B | back side |
| 14F | front side |
| 14L | lower edge |
| 14S | side edge |
| 14U | upper edge |
| 15 | fold score |
| 16 | tab |
| 18 | insulating sheet |
| 18T | top edge |
| 18B | bottom edge |
| 18L | left edge |
| 18R | right edge |
| 19 | grooves, score, or corrugations |
| 20 | adhesive area |
| 21 | adhesive area |
| 22 | fold edge |
| 22S | side seam |
| 24 | inner layer |
| 25 | insulating middle layer |
| 26 | outer layer |
| 27 | inside surface of cup |
| 28 | outside surface of cup |
| 30F | foil or metalized film |
| 30P | paperboard |
| 31 | holes |
| 33M | fluted medium |
| 33L | linerboard |
| 35P | paperboard |
| 35F | foamed layer |
| 40 | blank |
| 41 | fold score |
| 42 | insulating section |
| 42L | lower edge |
| 42S | side edge |
| 42U | upper edge |
| 42F | front side |
| 42B | back side |
| 43 | fold edge |
| 50 | cup |
| 51 | top curl |

FIRST EMBODIMENT

Sheet Blanks—FIGS. 1 and 2A TO 2E

In accordance with a first embodiment of the invention a cup or container (FIG. 1), includes bottom 11 and a sidewall 12. The bottom is formed from a bottom blank 11B (FIGS. 2D and 2E).

Sidewall 12 is formed from sidewall blank 12B (FIG. 2A), which is die cut from a larger sheet or roll (not shown) of paper or other suitable sheet material. The preferable thickness of this material is approximately 0.33 mm (13 mils), but it can be in a range of 0.2 to 0.6 mm (8 to 24 mils). (One mil=0.001 inch.) The blank includes an arc-shaped left section 13, which will form an outer layer of the sidewall, and an arc-shaped right section 14, which will form an inner layer of the sidewall. The two sections border or share a common fold score 15. The purpose of this fold score is to assist in folding the blank along a precise line. Score 15 is preferably formed into sidewall blank 12B at the time that the blank is die cut from the larger starting sheet. However, the score can be formed into blank 12B after the blank is cut, but prior to being folded (operation discussed below). Sections 13 and 14 have respective side edges 13S and 14S, upper edges 13U and 14U, and lower edges 13L and 14L. Sections 13 and 14 also have front sides 13F and 14F, respectively, and back sides 13B and 14B, respectively.

Once blank 12B is formed into sidewall 12 (operation discussed below), back side 13B will form an outside surface 28 of the cup, and back side 14B will form an inside surface 27 of the cup (FIG. 1). For reasons to be described, section 13 is longer from side edge 13S to fold score 15 than section 14 is from side edge 14S to fold score 15. Section 14 is taller from upper edge 14U to lower edge 14L than section 13 from upper edge 13U to lower edge 13L. Section 13 includes a small tab 16, which extends from lower edge 13L to fold score 15, for purposes to be described.

Sidewall blank 12B has been coated on at least the back side (sides 13B and 14B) with a known waterproof material (not shown), such as plastic. Bottom blank 11B has been coated on at least inner surface 11I with a similar waterproof material. Preferably polyethylene is used (low, medium or high density) because it serves as both an adhesive and a waterproof coating. Other types of waterproof and heat sealable coatings can be used in lieu of polyethylene, including polypropylene or polyester. Currently, other types of biodegradable and/or recyclable waterproof and heat sealable coatings are being developed within the industry. Once available, these types of coatings can also be used. The preferable thickness of the polyethylene coating is 0.019 mm (0.75 mil), but can be in a range of 0.013 mm (0.5 mil) to 0.038 mm (1.5 mils). The coating can have either a matte or a gloss finish. Various methods of applying the coating are well known in the art.

Sidewall 12 also includes a second component—an insulating sheet 18 (FIGS. 2B and 2C), which will form a middle layer of the sidewall. This sheet is die cut from a larger sheet or roll (not shown) of paper or other suitable sheet material. Preferably the thickness of this material is 0.4 mm (16 mils), but can be in a range of 0.25 to 1 mm (10 to 40 mils). It is preferably made from recycled chipboard (plain chip or bending chip) or from recycled liner board, because this material is cost effective and recycled. Alternatively, it can be made from virgin paperboard or partially recycled paperboard such as SBS (solid bleach sulfite) or SUS board (solid unbleached sulfite). It has a top edge 18T, a bottom edge 18B, and left and right edges 18L and 18R, respectively.

Figure 2A:
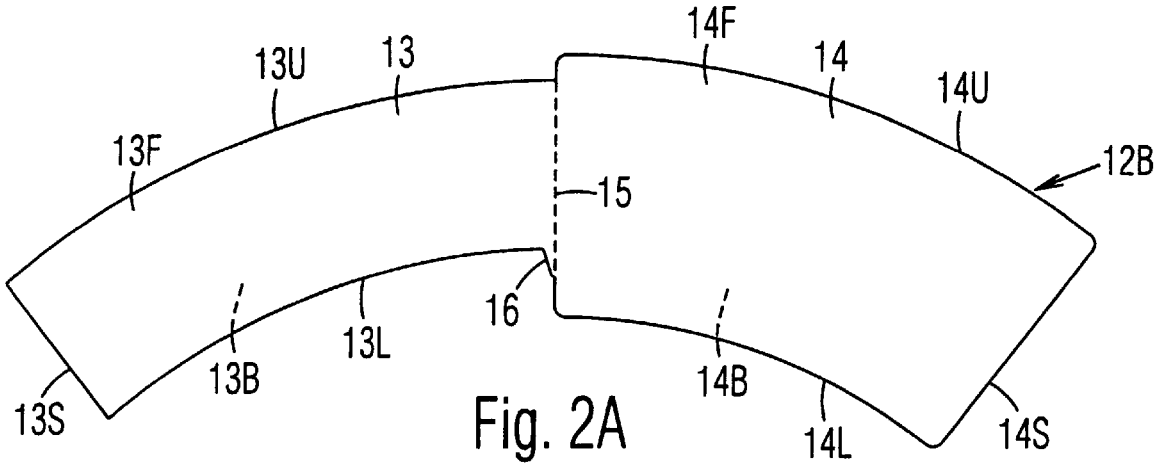
FIG. 2A is a plan view of a cup blank used to make the cup of FIG. 1.
Figure 2B:
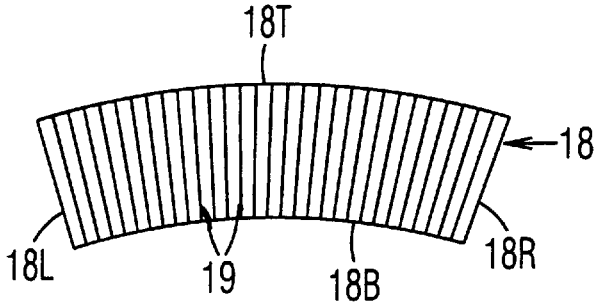
FIG. 2B is a plan view of an insulating layer used in the cup of FIG. 1.
Figure 2C:
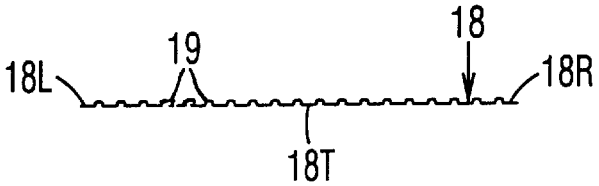
FIG. 2C is a side view of the insulating layer.
Figure 2D:
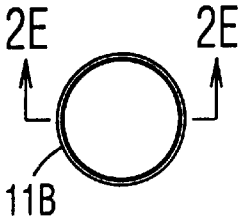
FIG. 2D is a plan view of the bottom blank of the cup.
Figure 2E:
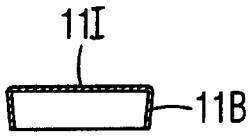
FIG. 2E is a sectional view of FIG. 2D taken along the line 2E—2E.

Sheet 18 includes spaced grooves or scores 19 (FIG. 2C) formed into its surface. These provide air space within sidewall 12. The scores run substantially from top edge 18T to bottom edge 18B (FIG. 2B). Preferably the scores are in a range of 3 to 13 mm (⅛" to ½") apart and in a range of 0.13 to 0.76 mm (5 to 30 mils) deep. The scores are formed by a known die operation (not shown). Preferably the scores are placed into the sheet simultaneously while cutting it from a larger starting sheet. However the scores can be formed prior to, or after cutting the sheet. Instead of scores 19 running from top to bottom, they can be positioned to run from side 18L to side 18R. Instead of scores or corrugations embossed dimples or any other type of integral deformities can be formed into the sheet. The area of the sheet is smaller than the area of either sections 13 or 14 of FIG. 2A for reasons to be described. Besides the examples given above, many different types of materials and structures can be used to serve as an insulating middle layer of sidewall 12. These will be described later.

Figure 3A:
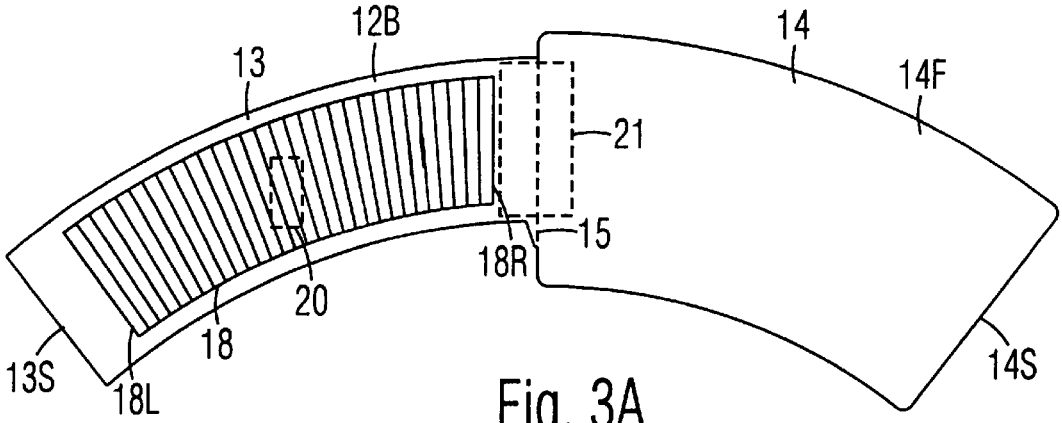
FIG. 3A is a plan view of a sidewall blank used to make the cup during the application of adhesive.
Figure 3B:
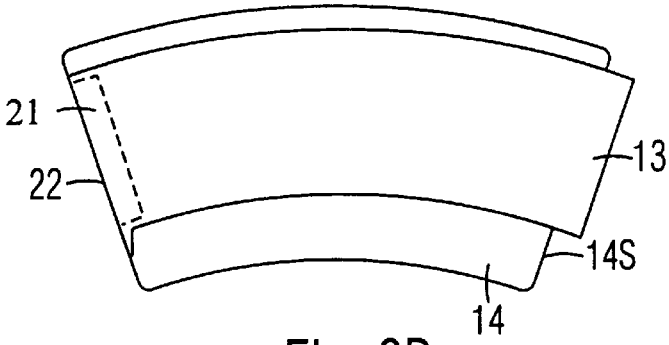
FIG. 3B is a plan view of the sidewall blank after folding.
Figure 3C:
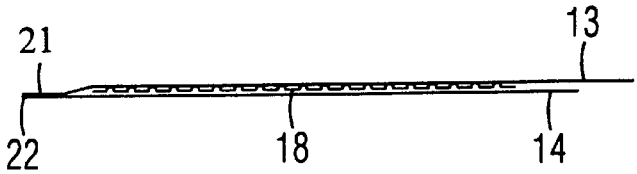
FIG. 3C is a side or edge view of the sidewall blank after folding.

Placing and Folding—FIGS. 3A to 3C

After sidewall 12B (FIG. 2A) and layer 18 (FIG. 2B) are cut and formed, they are assembled into sidewall 12 (FIG. 1) as follows: Sheet 18 is attached onto sidewall blank 12B to provide the assembly of FIG. 3A. First a small amount of adhesive, preferably hot-melt adhesive, is applied near the center of section 13F at adhesive area 20. Sheet 18 is then placed in a substantially centered position on section 13F, where it is held in place by the adhesive. Because sheet 18 is smaller than section 13, its edges do not extend to the edges of section 13. Preferably there is a gap or margin of at least 6 mm (¼") between left edges 18L and 13S, right edge 18R and fold score 15, top edges 18T and 13U, and bottom edges 18B and 13L.

Next a small amount of adhesive, preferably cold adhesive, such as a starch-based adhesive or paste, is applied to blank 12B at or adjacent to fold score 15, at adhesive area 21.

Section 13 is then folded over section 14 (or vice-versa), to form a flat three-layered arrangement having a fold edge 22 (formerly fold score 15) with sections 13 and 14 on opposite sides of insulating sheet 18 (FIGS. 3B and 3C). Sections 13 and 14 are glued, bonded or otherwise fastened directly to each other (i.e. directly between the two layers) at bond area 21 adjacent fold edge 22, on the inside surface of folded blank 12B (FIGS. 3B and 3C). This bond serves to hold blank 12B in the folded state. As will be described later, it is important to the forming of the sidewall that sections 13 and 14 be fastened to each other only at or near fold edge 22, preferably at a distance not to exceed 5.1 cm (2") from fold edge 22.

The placing and folding operation is preferably performed by a machine (not shown) called a folder-gluer, which is a standard piece of machinery used to make folding cartons and boxes. A placing machine (such the machine sold under the trademark Pick 'n Place by MGS Machine Corp. of Maple Grove, Minn., not shown) is attached to the folder gluer. Blank 12B is loaded into the feeding station of the folder-gluer and insulating sheet 18 is loaded into the feeding station of the placing machine. First, blank 12B is moved into position under an adhesive applicator (not shown) where adhesive (preferably hot-melt adhesive because of the fast tack time required) is applied at area 20. Next, the blank is moved into position under the placing machine, where insulating sheet 18 is placed onto section 13F and held into place by the adhesive. Next, blank 12B (FIG. 3A) is moved into position under another adhesive applicator where adhesive is applied at area 21, near score 15. Finally, section 13 is folded over section 14 and the two sections are held together at area 21 by the adhesive on the inside surface of folded blank 12B, thereby forming the flat, three-layered arrangement shown in FIGS. 3B and 3C. The adhesive used to attach sections 13 and 14 at area 21 is preferably a cold-glue or paste adhesive, because minimal thickness is desired adjacent fold 22. Other types of adhesives can be used to bond sections 13 and 14 at area 21. For example hot-melt adhesive can be applied, or a preapplied layer of thermoplastic material, such as polyethylene, can be used. In the latter example the thermoplastic material is heat activated and sections 13 and 14 are bonded to each other at area 21 through the application of heat and pressure.

Obviously to make the cup, sheet 18 can be attached to section 14F (rather than section 13F) in the same manner as described above. If sheet 18 is attached to section 13F, it will be attached to the outer layer of sidewall 12 (because section 13 forms the outer layer of the sidewall). Similarly, if sheet 18 is attached to section 14F, it will be attached to the inner layer of sidewall 12 in finished cup 50. In either case, sheet 18 still provides an insulating middle layer 25 (FIG. 4B) of sidewall 12 sandwiched between inner and outer layers 24 and 26.

Figure 4A:
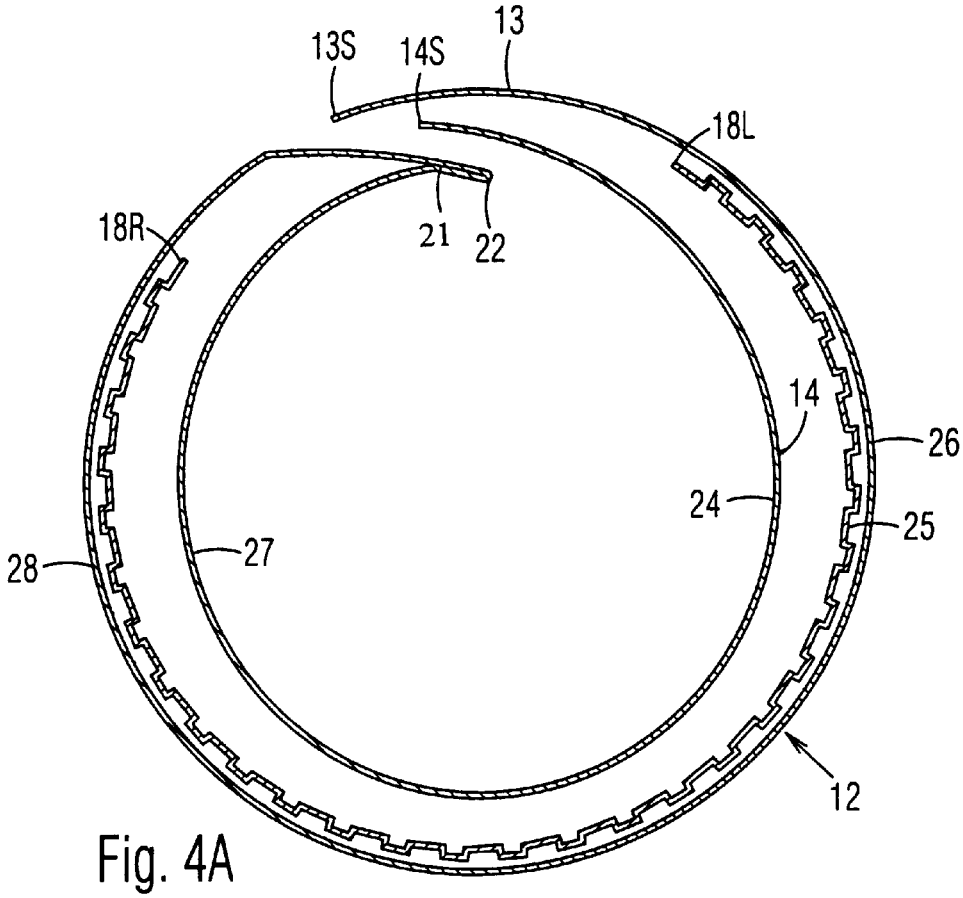
FIG. 4A is a sectional view of the blank after wrapping but before sealing.
Figure 4B:
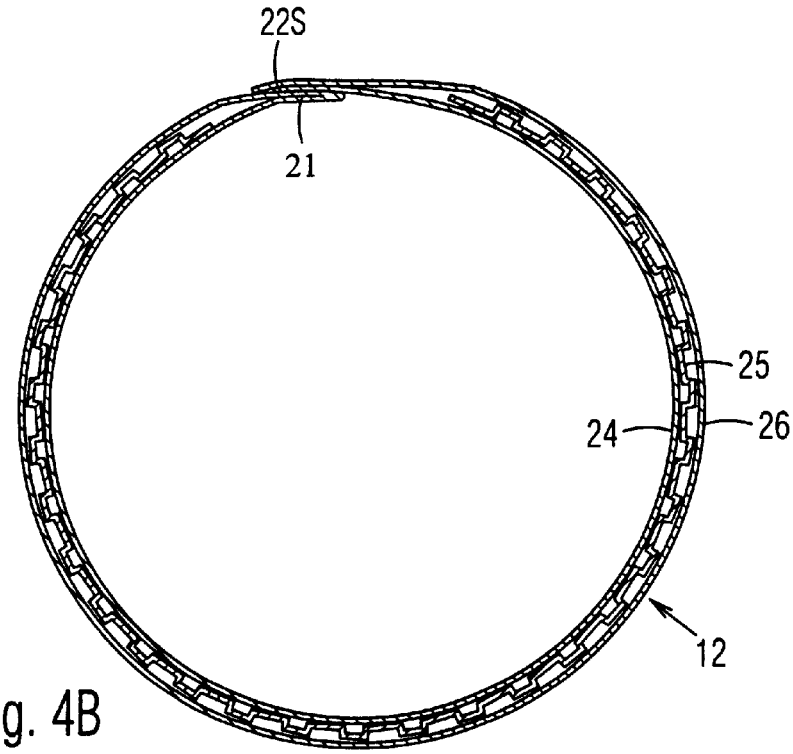
FIG. 4B is a sectional view of the blank after wrapping and sealing.

Wrapping and Forming—FIGS. 4A and 4B

Next, the three-layered arrangement shown in FIGS. 3B and 3C is wrapped or bent around a known tapered mandrel (not shown) to form sidewall 12 (FIG. 4A) having inner layer 24, middle layer 25, and outer layer 26. The wrapping is done such that fold edge 22 is inside and thus becomes part of inner layer 24. A marginal portion of section 14 adjacent edge 14S overlaps a marginal portion of section 13 adjacent fold edge 22. Section 13 is longer than section 14 so that edge 13S overlaps both edge 14S and a marginal portion of section 13 adjacent folded edge 22. These overlapping layers are heat sealed together through the application of heat and pressure to form a side seam. The heat fuses and joins the previously applied layer of polyethylene or other heat sealable and waterproof coating. Note from FIG. 4B, a sectional view of the wrapped sidewall after sealing, that the overlapping edges form a side seam 22S.

Insulating sheet 18 does not extend completely around sidewall 12, i.e., it covers less than 100% of the circumference of the sidewall. This is clearly shown in FIG. 4B. This is because sheet 18 is not as long as sections 13 or 14. As such, left and right edges 18L and 18R, are not parts of side seam 22S. This is an advantage because it saves paper, and it reduces the thickness of the side seam (by two layers). Likewise insulating sheet 18 does not cover the entire vertical length of the cup sidewall as shown in FIG. 1. Again this is an advantage because it saves paper without significantly effecting the insulating performance of the cup.

An important feature of the cup is the location in which sections 13 and 14 are adhesively bonded or otherwise fastened to each other when blank 12B is folded. Sections 13 and 14 are fastened to each other on the inside surfaces of the folded blank (FIG. 3B and FIG. 3C) so that blank 12B stays in a flat, three-layered arrangement prior to wrapping. If the sections were not glued, blank 12B may come unfolded prior to wrapping and sealing. I have found that by fastening sections 13 and 14, much higher production speeds are possible on standard machinery, thereby providing a less expensive manufacturing process. As discussed, it is very important that section 13 be bonded or fastened to section 14 at or near fold edge 22, no further than 5.1 cm (2") from fold edge 22, at bond area 21, which becomes the inside surfaces of the folded blank. This is necessary in order to wrap the flat three-layered arrangement into sidewall 12.

As shown in FIG. 4A, outer layer 26 has a larger circumference than inner and middle layers 24 and 25, respectively. Because of this larger circumference, section 13 must travel a greater distance relative to section 14 as the blank is wrapped. Because section 13 is attached to section 14 at fold edge 22, section 13 must compensate for this greater distance of travel by moving or sliding around section 14, such that the distance between edges 13S and 14S shortens as the blank is wrapped. If section 13 were glued or otherwise fastened to section 14 at a location too far from fold edge 22, it would cause the portion of section 13 which lies between fold edge 22 and the location of fastening to be unable to slide relative to section 14. If this were to occur fold edge 22 would not lie flat and substantially parallel to the other edges as shown in FIG. 4A, as blank 12B is wrapped around a mandrel, and side seam 22S would not be sealed properly. However, I have found that by fastening section 13 to section 14 at or adjacent fold edge 22 (at bond area 21) this negative effect is mitigated and section 13 is allowed to slide relative to section 14 as it is wrapped. By bonding section 13 to section 14 adjacent fold edge 22, the fold edge will lie flat and substantially parallel to the other edges as shown in FIG. 4A as blank 12B is wrapped, thereby allowing side seam 22S to be sealed properly, as shown in FIG. 4B.

In order to finish cup 50 (FIG. 1), upper edge 14U (FIG. 2A) of inner layer 24, which is extends past upper edge 13U, is rolled radically outward to form a rim. Bottom blank 11B (FIGS. 2D and 2E), is attached to inner layer 24 and lower edge 14L, is folded inward and heat sealed to bottom blank 11B. Various methods of forming the rim and sealing the bottom are well known in the art.

The purpose of tab 16 (FIG. 2A) on section 13 is to help prevent leaking. This tab extends from the side seam, into the seal between bottom blank 11B and inner layer 24.

In this cup a problem that has plagued all paper cups is eliminated. That is the problem, discussed above, associated with having a cut edge along the side seam on the inside of the cup. Because there is no waterproof coating on the cut edge, moisture migrates, wicks, or seeps into the paper over time, and may cause leaking. In the current cup there is no raw edge inside the cup. Rather fold edge 22, which is coated with a waterproof material, is on the inside layer of the cup. Cup 10 is therefore more resistant to moisture migration and leaking than a standard paper cup, and therefore provides a longer shelf life.

Many standard paper cups are coated with polyethylene on both sides of the cup blank in order to waterproof the inside, and provide a coated printable surface on the outside. Coating both sides of the blank costs more than coating only one side and it is more detrimental to the environment. As discussed above, if blank 12B is coated on at least back sides 13B and 14B, the coating will end up on both inside surface 27, fold edge 22, and outside surface 28 of sidewall 12 (FIGS. 1 and 4A). This saves costs because coating both sides of blank 12B is not necessary to waterproof both the inside and outside surfaces of the cup.

I have found it useful to use a suction cup with vacuum, in combination with a PTFE-coated lower clamp pad, on the cup machine at the blank wrapping station in order to hold a central portion of section 14L (which extends past section 13L) stationary as the blank is wrapped around the mandrel. This allows section 13, which forms outer layer 26, to slide along the PTFE lower clamp pad, relative to stationary inner layer 24, which is held in place by the vacuum cup when sidewall 12 is formed.

Alternative Insulating Materials

As mentioned above, many different types of insulating materials can be substituted for insulating sheet 18 (FIG. 2B).

Figure 5:
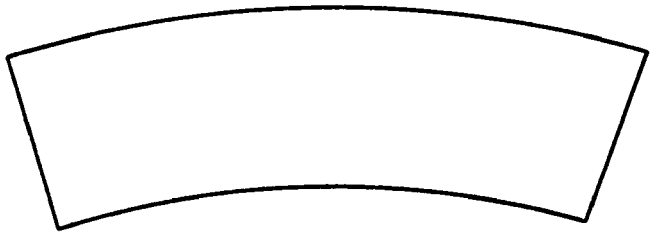
FIG. 5 is a plan view of a plain, unscored blank for the middle layer.

Flat, Unscored Insulating Sheet—FIG. 5

For some applications it is more suitable to use a flat unscored paperboard sheet (FIG. 5) instead of insulating sheet 18 for the middle insulating layer. In this case a thicker board can be used to offset the insulation efficiency lost by not scoring the sheet. The preferable thickness of unscored paperboard, such as chipboard, linerboard, SBS, or SUS board is in a range of 0.25 to 1 mm (10 to 40 mils).

Figure 6A:
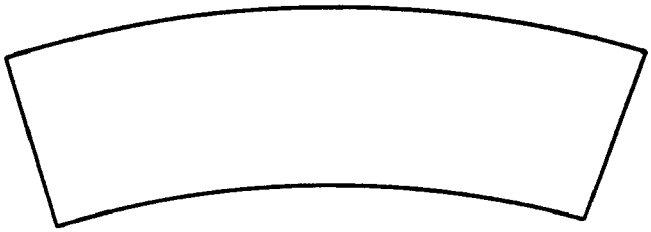
FIG. 6A is a plan view of a foil-laminated blank for the middle layer.
Figure 6B:
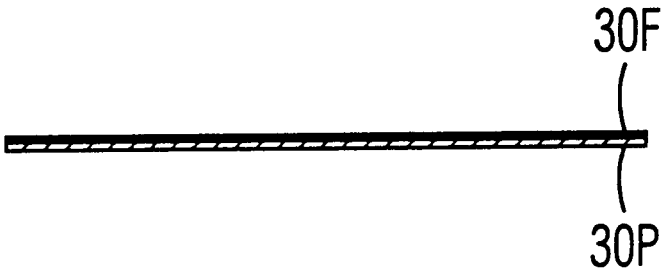
FIG. 6B is a sectional view of the foil-laminated blank.

Foil Or Metalized Film Laminated Insulating Sheet—FIG. 6

For some applications it is desirable to use a sheet (FIG. 6A) that has been laminated with foil or metalized film, instead of insulating sheet 18, for the middle insulating layer. Foil and metalized film act as excellent moisture barriers and also serve to reflect radiant heat, thereby providing added insulation. I have found that both flat and scored foil or metalized film laminated paperboard will provide effective insulation and serve as moisture barriers. A foil or metalized film 30F (FIG. 6B) is laminated to at least one side of a paperboard sheet 30P. The preferable thickness of the foil or metalized film is between 0.013 to 0.05 mm (0.5 to 2.0 mils). The preferable thickness of the paperboard to which the foil is laminated is in a range of 0.25 mm to 1 mm (10 to 40 mils). Metalized film laminated chipboard can be purchased from Jefferson Smurfit Corporation of Santa Clara, Calif. Because the sheet is trapped between inner layer 24 and outer layer 26, a cup made with this type of insulating layer may be used in microwave applications, without the metal causing arcing.

Figure 7:
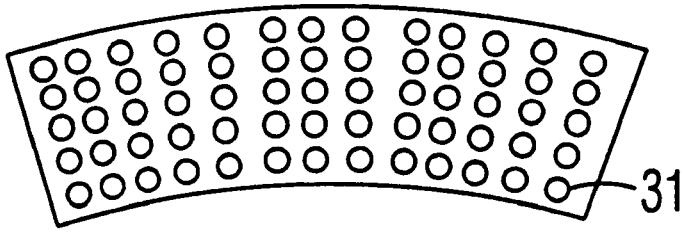
FIG. 7 is a plan view of a foraminous blank for the middle layer.

Foraminous Flat Insulating Sheet—FIG. 7

For some applications it is desirable to use a foraminous sheet (FIG. 7), i.e., the sheet has a plurality of holes cut throughout the surface, instead of insulating sheet 18, for the middle insulating layer. The holes 31 (which may be shapes other than circles, such as triangles, squares or rectangles) are cut into a flat sheet of paperboard. The preferable thickness of the flat sheet is the same as in FIG. 5. The holes have the dual benefit of providing insulating air space between inner and outer layers 24 and 26, and reducing the weight of the finished cup. The holes can be cut into the surface of the sheet with a standard die cutting operation, which is well known in the art.

Figure 8:
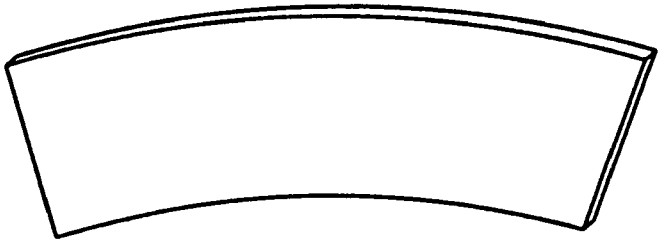
FIG. 8 is a plan, partly perspective view of a foam blank for the middle layer.

Foam Insulated Sheet—FIG. 8

For some applications it is desirable to use a sheet FIG. 8 that is made from foam, preferably expanded polystyrene, instead of insulating sheet 18, for the middle insulating layer. Polystyrene foam is a lightweight and cost effective material with good thermal insulating properties. The sheet can be die cut from a larger starting sheet of polystyrene foam, or it can be thermoformed or extruded to the proper finished size. The methods of providing sheet from polystyrene foam are well known in the art. The preferable thickness of this sheet is the same as the sheet of FIG. 5. Due to its porous structure, this sheet has the dual benefits of providing insulating air space between inner and outer layers 24 and 26, and reducing the weight of the finished cup.

Figure 9A:
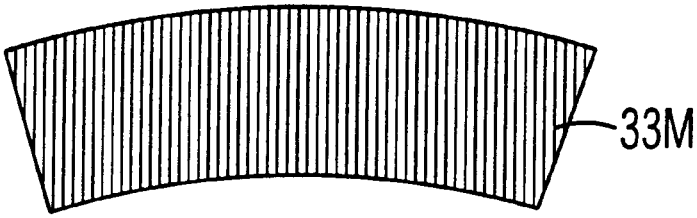
FIG. 9A is a plan view of a fluted paperboard blank for the middle layer.
Figure 9B:
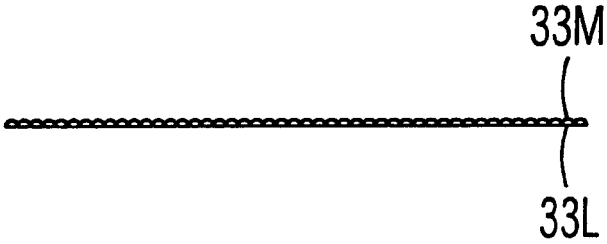
FIG. 9B is a sectional view of the fluted paperboard blank laminated to a linerboard for the middle layer.

Fluted Paperboard Insulating Sheet—FIG. 9

For some applications it is desirable to use a sheet (FIG. 9) that is made from fluted paperboard, instead of insulating sheet 18, for the middle insulating layer. The sheet may consist of fluted medium 33M alone (FIG. 9A), or sheet 33M in combination with a liner board 33L (FIG. 9B) which is adhered to sheet 33M at the tips of the flutes. This type of material is often referred to as microflute. The methods of making fluted paperboard are well known in the art. The preferable thickness of this sheet is similar to the sheets of FIGS. 5 to 8. Fluted paperboard is readily available from a number of suppliers. This sheet can die cut from a larger starting sheet or roll (not shown) by a standard die cutting operation.

Water-Soluble Insulating Sheet

For some applications it is desirable to use a sheet (appearance similar to the sheet of FIG. 5) that is made from a water-soluble material, instead of insulating sheet 18, for the middle insulating layer. This sheet is constructed of a water-soluble material, such as a starch-based material. The material is typically extruded into sheet form. It can be die cut from a larger starting sheet (not shown). The thickness of this sheet is preferably the same as the sheet of FIG. 5. Due to its porous structure and water solubility, this sheet has the dual benefits of providing insulating air space between the inner and outer layers and reducing the weight of the cup.

Figure 10A:
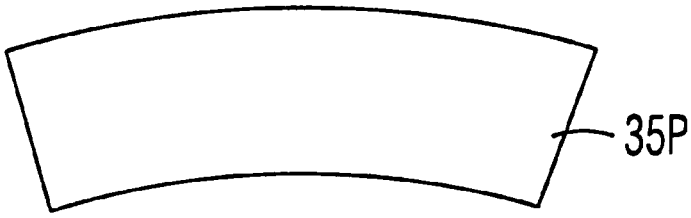
FIG. 10A is a plan view of a foam-coated paperboard sheet blank for the middle layer.
Figure 10B:
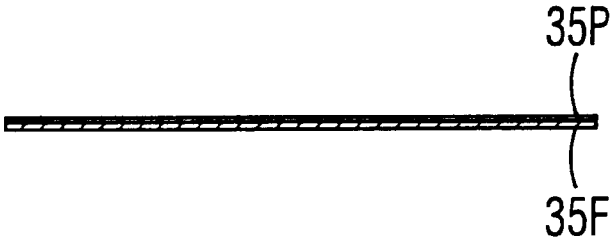
FIG. 10B is a sectional view of the foam-coated paperboard blank.

Foam-Coated Insulating Sheet—FIG. 10

For some applications it is desirable to use a sheet (FIG. 10A) that is constructed from a paperboard sheet 35P with a foamed heat-insulating layer 35F (FIG. 10B) coated on at least one side, instead of insulating sheet 18, for the middle insulating layer. Layer 35F is formed from thermoplastic synthetic resin, which is a low-to-medium density polymer and may include (but is not limited to) polyethylene, polyolefin, polyvinylchloride, polystyrene, polyester, nylon, and other similar types of material. The thermoplastic synthetic resin is extruded onto paperboard sheet 35P and then heated at a temperature in the range of 93° to 204° C. (200° to 400° F.) for between 30 seconds to 2.5 minutes. Upon the application of heat, the polymer will foam. The preferable thickness of this foam-coated sheet is in a range of 0.3 to 1 mm (12 to 40 mils). Various methods of making a foam-coated sheet are well known in the art. The foam-coated sheet will provide insulating air space between the inner and outer layers.

Finally, for all of the above alternative embodiments of sheet 18, any of the sheets can be provided in more than one piece, in order to cover the same area as sheet 18. For example sheet 18 can be provided as two or more separate pieces that are each adhesively attached to section 13F or 14F to provide insulating layer 25.

SECOND EMBODIMENT

Foam Coating For Middle Layer

In a second embodiment, the use of a separate insulating sheet is eliminated entirely. It is replaced with a layer of foam which is coated on sections 13F and/or 14F of blank 12B (FIG. 2A) to produce a paper and foam-coated structure similar to that shown in FIG. 10B. In order to provide the layer of foam, section 13F (and/or section 14F) of blank 12B is first coated with a layer of thermoplastic synthetic resin film. The thermoplastic synthetic resin is a low-to-medium density polymer. Such a polymer may include (but is not limited to) polyethylene, polyolefin, polyvinylchloride, polystyrene, polyester, nylon and other similar types of materials. I prefer to use a low-density polyethylene. Opposing sections 13B and 14B of blank 12B are coated with a high-density polyethylene film. Next, blank 12B is heat treated at a temperature and for a time sufficient to permit the low density thermoplastic synthetic resin film to foam and form a heat-insulting layer. Depending upon the melting point of the thermoplastic synthetic resin chosen, the material is heated at a temperature as stated above in the discussion of FIG. 10. Because the low-density polyethylene film has a lower melting point than high density polyethylene film, low density film foams, while high density film does not. Blank 12B can be heat treated in the unfolded state of FIG. 2A or in the folded state of FIG. 3B.

In this embodiment, the foamed layer coated on blank 12B replaces sheet 18. When blank 12B is wrapped and sealed, the foamed layer provides the middle insulating layer, which is sandwiched between inner and outer layers 24 and 26 respectively. With the exception of coating section 13F and 14F with a layer of thermoplastic synthetic resin and heat treating the resin until it foams, the cup is made in substantially the same manner as described in the first embodiment.

Although I prefer to form the foam layer through the process described above, the foam layer can also be provided by spraying, extruding, or otherwise applying a foamable or foamed material directly to sections 13F and/or 14F of blank 12B prior to folding. This operation can be accomplished while the blank is positioned upon, and moving along, the folder gluer prior to being folded. Upon folding and wrapping, the foam layer becomes insulating layer 25, thereby replacing the need for insulating sheet 18.

THIRD EMBODIMENT

FIGS. 11A TO 13B

In accordance with a third embodiment, blank 12B and insulating sheet 18 can be replaced with blank 40 (FIG. 11B) to form cup or container 50 (FIG. 1).

Figure 11A:
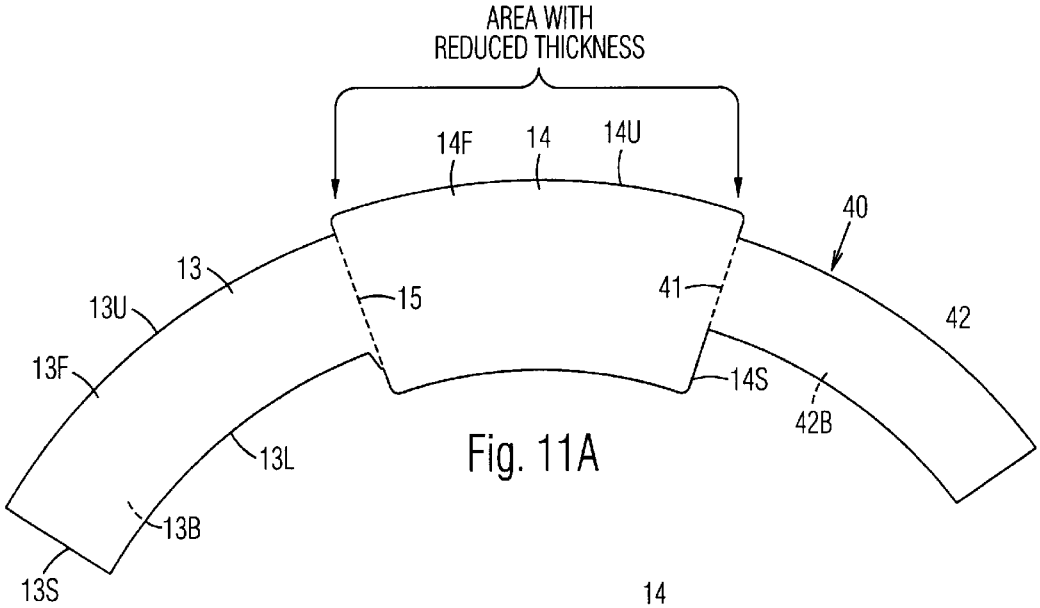
FIG. 11A is a plan view of an alternative starting blank for the cup.
Figure 11B:
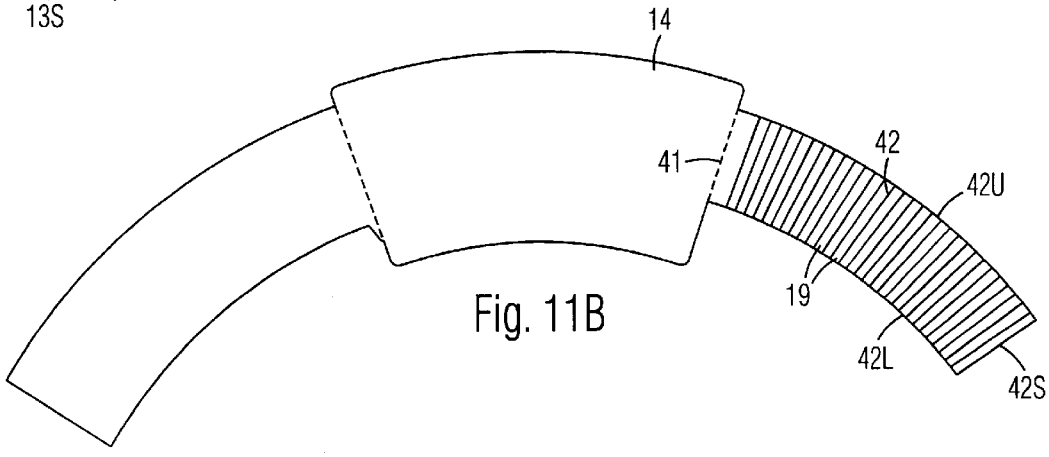
FIG. 11B is a plan view of the alternative starting blank after grooves are formed into the insulating section.

Sheet Blanks and Scoring—FIGS. 11A TO 11B

Figure 13A:
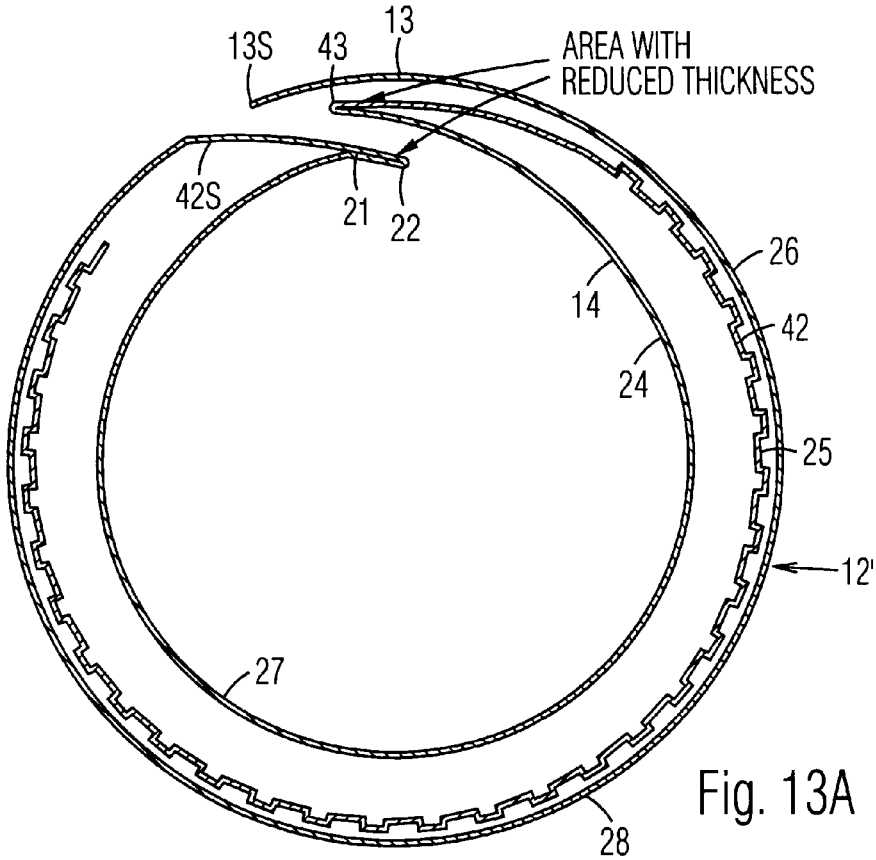
FIG. 13A is a sectional view of the blank after wrapping but before sealing.
Figure 13B:
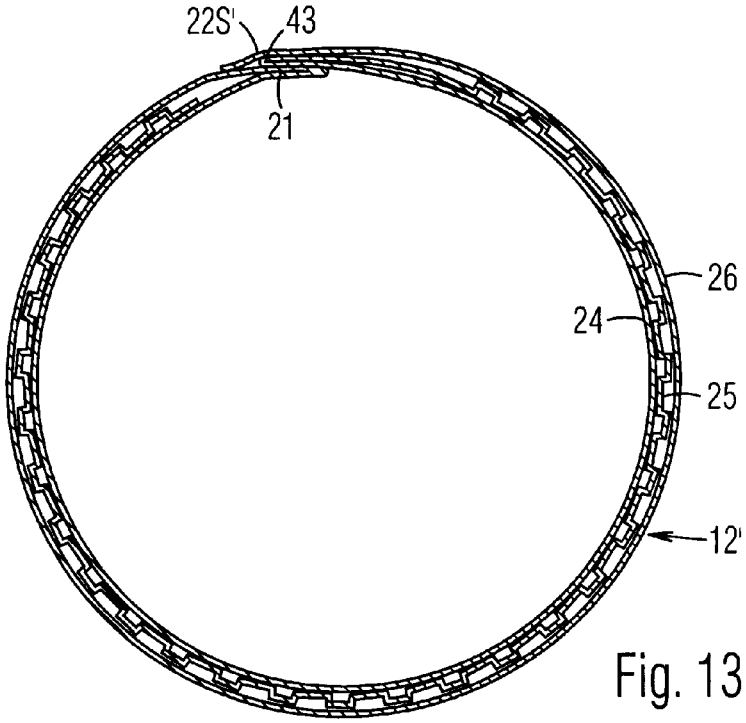
FIG. 13B is a secional view of the blank after wrapping and sealing.

Blank 40 (FIG. 11A) is die cut as a single sheet from a larger sheet or roll (not shown) of paper or other suitable sheet material. The preferable thickness of this material is approximately 0.33 mm (13 mils), but it can be in a range of 0.2 to 0.6 mm (8 to 24 mils). Blank 40 is similar to blank 12B (FIG. 2A), except that it has three sections: left section 13, right section 14, and an insulating section 42. Left 13 and right sections 14 share common fold score 15, and are substantially identical to sections 13 and 14 of FIG. 2A. Insulating section 42 (which replaces insulating sheet 18) is connected to section 14 at fold score 41. Section 42 includes upper edge 42U, lower edge 42L, side edge 42S, front side 42F and back side 42B. Sections 13, 14 and 42 will form respective outer, inner, and insulating middle layers of sidewall 12' (FIGS. 13A and 13B).

Sidewall blank 40 has been coated on at least the back side (sides 13B, 14B and 42B) with a known waterproof material (not shown), such as polyethylene, as more fully described in the first embodiment.

Next, spaced grooves, corrugations, or scores 19 are formed into section 42 for providing insulating air space within sidewall 12'. The scores are substantially the same as the scores of FIG. 2B and FIG. 2C. The scores run substantially from top edge 42U to lower edge 42L. Preferably the scores are in a range of 3 to 13 mm (⅛" to ½") apart and in a range of 0.13 to 0.76 mm (5 to 30 mils) deep. In order to form the scores, a rotary die station (not shown) can be attached to a folding-gluer (not shown). As blank 40 (FIG. 11A) travels along the folder-gluer, section 42 passes between rotary dies that form scores 19 into section 42 to produce the scored blank of FIG. 11B. Alternatively, scores 19 can be formed into section 42 at the time the blank is die cut from a larger starting sheet or roll. Instead of scores 19 running from top to bottom, they can be positioned to run horizontally from side 42S to score 41. Instead of scores or corrugations, embossed dimples or any other type of integral deformities can be used.

Figure 12A:
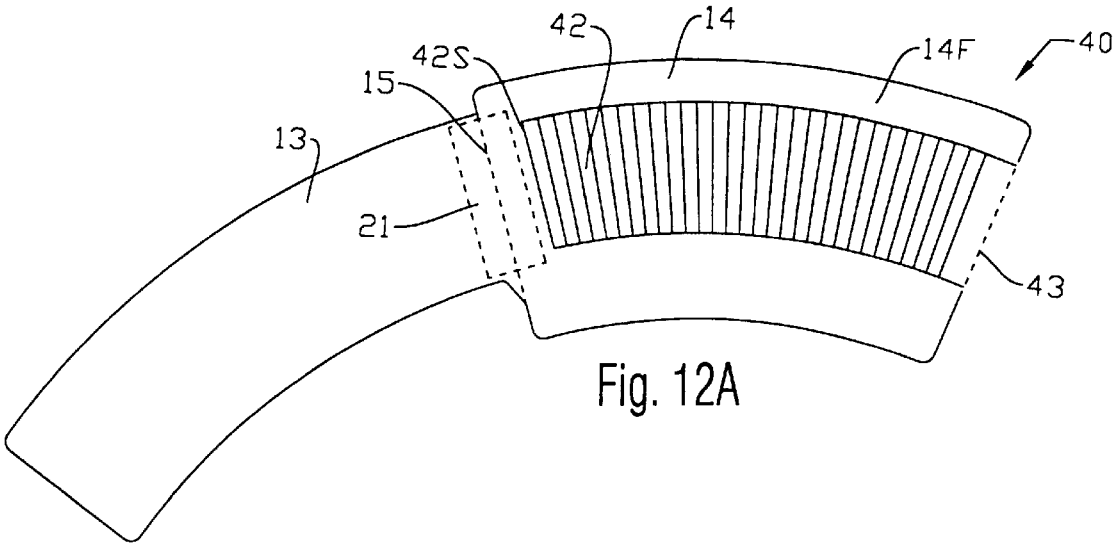
FIG. 12A is a plan view of the blank after folding the insulating section.
Figure 12B:
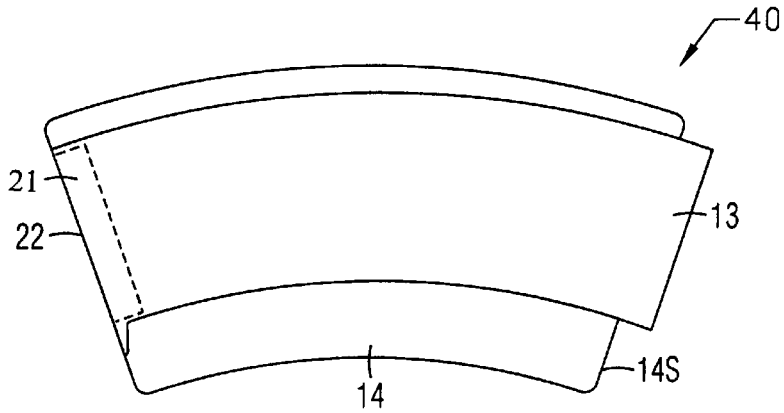
FIG. 12B is a plan view of the blank after folding the insulating section and the left section.
Figure 12C:
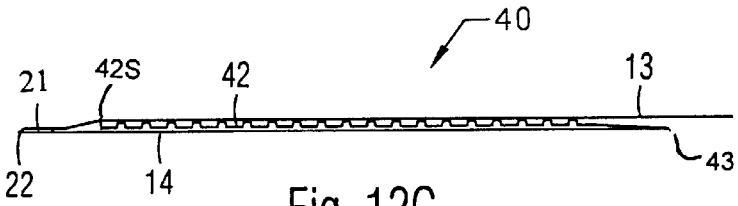
FIG. 12C is a side or edge view of the blank after folding the insulating section and the left section.

Folding—FIGS. 12A TO 12C

Next section 42 is folded over on onto section 14 at fold score 41 (FIG. 12A). Adhesive, such as paste adhesive, cold glue, or hot melt is applied at area 21 adjacent fold score 15. Section 13 is then folded over section 42, to form a flat, three-layered arrangement having fold edges 22 and 43, with sections 13 and 14 on opposite sides of insulating section 42 (FIGS. 12B and 12C).

Sections 13 and 14 are glued, bonded, or otherwise fastened to each other at bond area 21 adjacent fold edge 22, on the inside surfaces of folded blank 40. This bond serves to hold blank 40 in the folded state. As described more fully in the first embodiment, it is important to the forming of sidewall 12 that sections 13 and 14 be fastened to each other only at or near fold edge 22, preferably at a distance not to exceed about 5.1 cm (2") from fold edge 22.

As an optional step, insulating section 42 may be fastened to section 14 when it is folded, which will increase production speeds. This can be accomplished through the use of a small amount of adhesive applied to either section 14F or 42F prior to folding. The adhesive can be applied in a central location on section 14F or 42F, or at a location adjacent to fold score 41. Cup 12 can also be formed without adhering insulating section 42 to section 14. Section 42 can simply be held in place, in its folded state, between folded section 13 and 14 after they have been bonded at area 21.

The scoring and folding operation is preferably performed by a folder-gluer, described above. A rotary die station (not shown) is attached to the folding gluer. First blank 40 (FIG. 11A) is loaded into the feeding station of the folder-gluer. Blank 40 is carried along the machine and section 42 is passed between rotary dies which form the scores, ribs, grooves, or other type of corrugation into section 42. Next blank 40 (FIG. 11B) is moved into position under an adhesive applicator (not shown) where adhesive is applied either to section 14 or section 42. Next, section 42 is folded onto section 14 and attached (FIG. 12A). (Section 42 may be attached in a central location or at a location adjacent to fold score 41. Fastening section 42 to section 14 with adhesive is an optional step as discussed above.) Next, blank 40 (FIG. 12A) is moved into position under another adhesive applicator where adhesive is applied at area 21, adjacent fold score 15. Finally, section 13 is folded over section 42 and sections 13 and 14 are held together at area 21 by the adhesive on the inside surface of folded blank 40, thereby forming the flat, three-layered arrangement shown in FIGS. 12B and 12C. The adhesive used to attach sections 13 and 14 at area 21 is preferably a cold-glue or paste adhesive, because minimal thickness is desired adjacent fold edge 22. Other types of adhesives can be used to bond sections 13 and 14 at area 21. For example hot-melt adhesive can be applied, or a preapplied layer of thermoplastic material such as polyethylene, can be used. In the latter example the thermoplastic material is heat activated and sections 13 and 14 are be bonded to each other at area 21 through the application of pressure.

Wrapping—FIGS. 13A to 13B

Next, the three-layered arrangement shown in FIGS. 12B and 12C is wrapped or bent around a known tapered mandrel (not shown) to form sidewall 12' (FIG. 13A) having inner layer 24, middle layer 25, and outer layer 26. The wrapping is done such that fold edge 22 is inside and thus becomes part of inner layer 24. A marginal portion of section 14 adjacent fold edge 43 overlaps a marginal portion of section 13 adjacent fold edge 22. Section 13 is longer than section 14 so that edge 13S overlaps both fold edges 43 and 22. These overlapping layers are heat sealed together through the application of heat and pressure to form a side seam. The heat fuses and joins the previously applied layer of polyethylene or other heat sealable and waterproof coating. Note from FIG. 13B, a sectional view of the wrapped sidewall after sealing, that the overlapping edges form side seam 22S'.

Side seam 22S' formed by blank 40 (FIGS. 11) includes fold edge 43 (FIGS. 13) and the marginal (flat) portion of insulating section 42 adjacent fold edge 43. This increases the thickness of the side seam by one layer of paper over sideseam 22S (FIG. 4B). This extra thickness may be reduced (as indicated by the legend in FIG. 13A) by using a scything (thinning or shaving) unit to slice or shave a predetermined thickness off of a marginal portion of blank 40, prior to wrapping, such as in the area adjacent to fold score 15 or 41, as indicated by the legend in FIG. 11A.

Insulating section 42 does not extend completely around sidewall 12', i.e., it covers less than 100% of the circumference of the sidewall. This is clearly shown in FIG. 13A. This is because section 42 is not as long as sections 13 or 14. As such, side edge 42S is not part of side seam 22S'. This is an advantage because it saves paper and reduces the thickness of the side seam (by one layer). Likewise, insulating section 42 is not as tall, from upper edge 42U to lower edge 42L, as sections 13 or 14, and therefore does not cover the entire vertical length of the cup sidewall as shown in FIG. 1. Again this is an advantage because it saves paper without significantly effecting the insulating performance of the cup.

Once sidewall 12' has been formed, cup 50 is completed in the same manner as described in the first embodiment.

Conclusion, Ramifications, and Scope

The reader will see that I have provided a cup and a method of manufacture, which has improved thermal insulating properties. It uses less costly materials and is leak resistant. Also it can be formed more easily on existing cup machinery resulting in higher production speeds and lower manufacturing costs. Also it uses materials such as paper, which can be recycled and which are readily biodegradable and recyclable. Moreover it has a surface that is conducive to printing with sharp and crisp graphics, and has an exterior wall which does not have the undesirable look and feel of foam cups, thereby providing good consumer acceptance.

Although the above description contains many specificities, they should not be considered as limitations on the scope of the invention, but only as examples of the embodiments. Many other ramifications and variations are possible within the teachings of the invention.

For example, the materials, relative sizes, and arrangements of the parts can be varied.

The middle and outer layer can be extended to cover substantially all of the inner layer.

In any of the embodiments ribs, an array of dimples, corrugations, scores, etc., can be formed into the outer layer, thereby providing increase insulation and a better surface for gripping.

The use of a folder-gluer (not shown) in the production process also allows other operations to be accomplished if desired. For example, in the second embodiment, a foamable or foam layer can be applied to unfolded blank 12B as it is transported along the folder-gluer. In any of the embodiments, a coupon applying unit can be used on the folder-gluer to insert labels onto the blank. Heat-sealing promoters, such as that sold under the trademark Adcote by Morton International, Inc. of Chicago Ill., can be applied to sidewall blanks 12B or 40 as they are being transported along the folder gluer. These chemicals promote a better seal at the side seam, thus enhancing shelf life. Fold scores 15 and 41 can be placed into the sidewall blank, after it has been die cut and is traveling along the folder gluer. This operation can be accomplished by passing the blank between rotary dies. This will allow the flat starting blanks of FIGS. 2A and 11A to be manufactured even more efficiently on standard punch-through die cutters, which do not have the ability to score.

Various types of folding scores can be used for fold scores 15 and 41, such as a crease score, cut score, or skip-cut (perforation) score. Fold score 15 is preferably a crease score.

When making straight-wall containers, the sidewall blanks of FIGS. 2A to 3C, and FIGS. 11A to 12C should be straight, rather than taper-shaped.

In lieu of glue, the folded blank can be held or bonded in the folded condition in other ways, such coating the blank with waterproof plastic before folding with the use of heat to fuse the plastic coatings together in area 21. Also, the folded blank can be staked in this area to hold the sides of the folds together.

Therefore the reader is requested to determine the scope of the invention by the appended claims and their legal equivalents, and not by the examples given.

I claim:

1. A thermally insulated container, comprising:

a side wall enclosure which defmes an interior volume, said enclosure having top and bottom portions, with an opening at said top portion, a bottom closure attached to said bottom portion, said side wall enclosure being formed from a sheet, said sheet having first and second sections which are folded to form a folded sheet having a fold edge, said first section providing an inner layer of said enclosure and said second section providing an outer layer of said enclosure, said first and second sections having an inner surface, said folded sheet having a predetermined thickness of material removed from an area adjacent said fold edge, and an insulating middle layer sandwiched between said inner and outer layers.

2. The thermally insulated container of claim 1 wherein said side wall enclosure further includes a means for fastening said first and second sections directly together on said inner surface at an area adjacent said fold edge.

3. The thermally insulated container of claim 1 wherein said insulating middle layer is formed from a separate piece of sheet material.

4. The thermally insulated container of claim 1 wherein said insulating middle layer is formed from a foamed thermoplastic material.

5. The thermally insulated container of claim 1 wherein said insulating middle layer is formed from a foamed water-soluble, biodegradable material.

6. A method of making a container, comprising:

providing a bottom closure, providing a sheet having first and second sections separated by a fold score, said sheet having an inner surface and an outer surface, removing a predetermined thickness of material from said sheet at an area adjacent said fold score, providing insulating material and applying said material onto at least one of said sections on said inner surface, folding said first and second sections together at said fold score such that said insulating material is sandwiched between said first and second sections to form a multi-layered side wall blank having a fold edge and said inner surface is on an inside of said first and second sections, said blank having opposite end portions, joining said opposite end portions together to form a side wall having top and bottom portions, said first and second sections forming respective inner an outer layers of said side wall, and sealing said bottom closure to said bottom portion, thereby to form a container.

7. The method of claim 6, further including bonding said first and second sections directly together on said inner surface at an area adjacent said fold edge.

8. The method of claim 6 wherein said predetermined thickness of material is removed by scything.

9. The method of claim 6 wherein said insulating material is formed of a foamed thermoplastic material.

10. The method of claim 6 wherein said insulating material is formed of a foamed water-soluble biodegradable material.

* * * * *

UNITED STATES PATENT AND TRADEMARK OFFICE

CERTIFICATE OF CORRECTION

PATENT NO. : 6,196,454 B1
DATED : March 6, 2001
INVENTOR(S) : Claus E. Sadlier

It is certified that error appears in the above-identified patent and that said Letters Patent is hereby corrected as shown below:

Column14,
Line 30, change "defmes" to — defines —.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*